US006657622B2

(12) United States Patent
Park

(10) Patent No.: US 6,657,622 B2
(45) Date of Patent: Dec. 2, 2003

(54) FLAT PANEL DISPLAY WITH AN ENHANCED DATA TRANSMISSION

(75) Inventor: Jin-Ho Park, Kyongki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 204 days.

(21) Appl. No.: 09/886,022

(22) Filed: Jun. 22, 2001

(65) Prior Publication Data

US 2002/0008682 A1 Jan. 24, 2002

(30) Foreign Application Priority Data

Jul. 18, 2000 (KR) ..... 2000-40940

(51) Int. Cl.[7] ..... G09G 5/00
(52) U.S. Cl. ..... 345/205; 345/87; 345/99
(58) Field of Search ..... 345/87, 88, 89, 345/98, 99, 100, 103, 204, 205, 206, 3.1; 349/149, 150, 151, 152; 385/24; 710/70

(56) References Cited

U.S. PATENT DOCUMENTS

| | | | | | |
|---|---|---|---|---|---|
| 5,166,670 | A | * | 11/1992 | Takeda et al. | 345/100 |
| 5,739,887 | A | * | 4/1998 | Ueda et al. | 349/149 |
| 5,987,543 | A | * | 11/1999 | Smith | 710/70 |
| 6,334,012 | B1 | * | 12/2001 | Yoon et al. | 385/24 |
| 6,356,260 | B1 | * | 3/2002 | Montalbo | 345/204 |
| 6,456,353 | B1 | * | 9/2002 | Chen | 349/150 |
| 6,480,180 | B1 | * | 11/2002 | Moon | 345/98 |
| 6,525,718 | B1 | * | 2/2003 | Murakami et al. | 345/206 |
| 2002/0003507 | A1 | * | 1/2002 | Dodge | 345/3.1 |

* cited by examiner

*Primary Examiner*—Xiao Wu
(74) *Attorney, Agent, or Firm*—McGuireWoods LLP

(57) ABSTRACT

A flat panel display is provided in which column driver integrated circuits correspond in groups to a plurality of timing controllers, to thereby achieve improvements shortening the data transmission path while eliminating signal delay problems caused by a large-sized screen of the display panel.

15 Claims, 4 Drawing Sheets

FLAT PANEL DISPLAY WITH AN ENHANCED DATA TRANSMISSION

BACKGROUND OF THE INVENTION

1. Field of the Invention

The present invention relates in general to a flat panel display, and more particularly, to a flat panel display in which column driver integrated circuits correspond in groups to a plurality of timing controllers, to hereby shorten the data transmission path while taking advantage of eliminating signal delay problems caused by a large-sized screen of the display panel.

2. Description of the Related Art

In recent years, flat panel display devices, represented by liquid crystal display devices or plasma display panels, have seen widespread use in computers or displays, as an alternative to a typical display device, a cathode ray tube.

As flat panel display devices are developed for a particular use of display device to have screens of large size, a high resolution as well as enhanced data transmission techniques are required.

The data transmission techniques include those for transmitting bits of data for colors R, G and B from an image source to a display panel so as to produce images onto a screen.

To match increased screen size of flat panel display devices, a printed circuit board (PCB) mounted with timing controllers and other PCBs are connected by a flexible printed board or wire, rather than a single PCB is used for mounting of chip and wiring for data transmission.

However, such a conventional configuration suffers drawbacks in that lots of wires are required for data transmission, and a large volume of electromagnetic waves are emitted during an operation of signal transmission through a flexible printed board or wire, thus causing data distortion. Further, data transmission path becomes longer in accordance with the large screen size and it results in signal delay.

The above-described problems limits flat panel display devices in increasing sizes of screens, and a need therefore continues to exist for driver circuits of enhanced data transmission path and preventing signal delay.

SUMMARY OF THE INVENTION

It is therefore an object of the present invention to provide a flat panel display in which data transmission system is improved so as to thereby allow the display to have a large-sized screen, while at the same time eliminating problems of electromagnetic interference(EMI) and signal delay accompanied with the operation of data transmission.

To accomplish the object of the present invention, there is provided a flat panel display including a display panel for displaying a predetermined image onto a screen by a scan signal and a column signal; scan driver means mounted one-to-one to a plurality of first connection members which are electrically and physically connected to one another in a vertical direction of the display panel, and which supplies the scan signal; column driver means mounted one-to-one to a plurality of second connection members which are electrically and physically connected to one another in a horizontal direction of the display panel, and which supplies the column signal; a plurality of timing controllers mounted onto a PCB electrically and physically connected to the second connection members, and which correspond to the second connection members in groups and supply relevant data and control signals; and a distributing unit for distributing data and control signal being supplied from a predetermined image supply source and transmitting the data and control signal to the timing controllers.

Preferably, the timing controllers are mounted to each of the PCBs.

The present invention provides a flat panel display including a display panel for displaying a predetermined image onto a screen by a scan signal and a column signal; scan driver means mounted one-to-one to a plurality of first connection members which are electrically and physically connected to one another in a vertical direction of the display panel, and which supplies the scan signal; column driver means mounted one-to-one to a plurality of second connection members which are electrically and physically connected to one another in a horizontal direction of the display panel, and which supplies the column signal; a master timing controller having a distributor mounted onto a PCB electrically and physically connected to a portion of the second connection members which are clustered into plural groups including a first group, and which distributes into groups data and control signals being supplied from a predetermined image supply source, a signal processing unit for determining a timing format for a signal for the first group and generating and outputting a control signal corresponding to the determined timing format, and a signal transmitting unit for outputting signals for other groups excluding those for the first group output from the distributor; and one or more sub-timing controllers mounted onto each of PCBs electrically and physically connected to the second connection members, and which receive signals transmitted from the master timing controller, determine timing formats for the received signals, and generating and outputting control signals.

Preferably, the master timing controller and the sub-timing controller are mounted onto PCBs.

An advantage of the flat panel display according to the present invention is that the data transmitted from a predetermined image supply source is divided, and the data with the determined timing format is transmitted to the column driver IC, thereby shortening the transmission path, while at the same time eliminating the problems of signal delay or EMI.

DETAILED DESCRIPTION OF THE INVENTION

A flat panel display according to the present invention will be explained with reference to the attached drawings.

The flat panel display according to the present invention can be adopted to a liquid crystal display device or a plasma display panel. Such a flat panel display device employs optical shutter techniques for realizing a screen. The optical shutter acts in a liquid crystal display panel or a plasma display panel. A scan signal and a column signal are electrically supplied in vertical and horizontal direction, respectively, to operate optical shutter in pixel units in those display panels. The scan signal and the column signal are output from the corresponding driver ICs, respectively.

Figure 1:
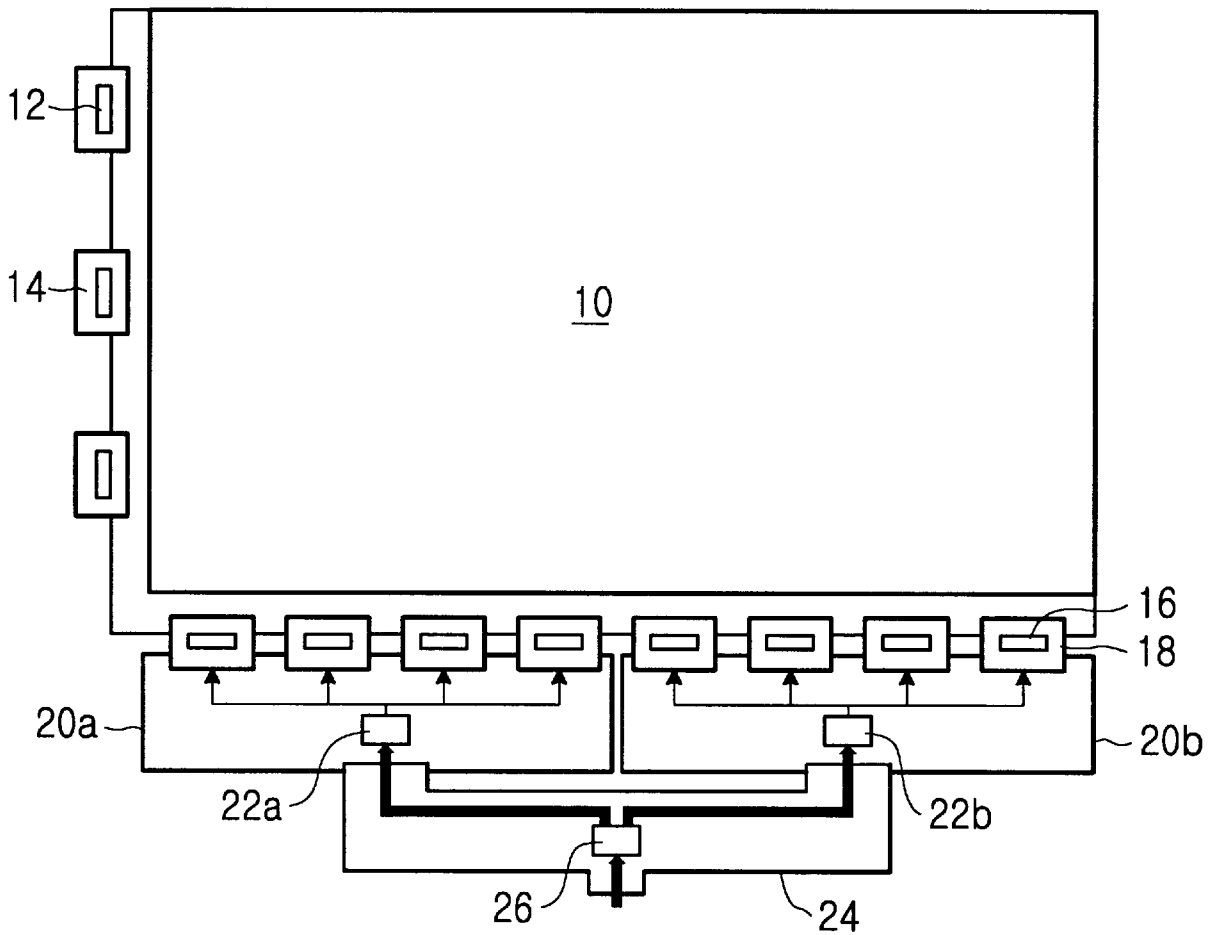
FIG. 1 is a plane view illustrating a flat panel display according to an embodiment of the present invention.

FIG. 1 illustrates a flat panel display according to an embodiment of the present invention. Referring to FIG. 1, a connection member 14 mounted with a scan driver IC 12 for outputting a scan signal is arranged in a vertical direction of a display panel 10, while a connection member 18 mounted with a column driver IC 16 for outputting a column signal is arranged in a horizontal direction of the display panel. The number of connection members 14 and 18 can vary depending on the resolution.

A predetermined number of the connection members 18 with the column driver ICs 16 constitute a group, and each group is configured in such a manner as to be provided with data from either of timing controllers 22*a* and 22*b*. Accordingly, each of the timing controllers 22*a* and 22*b* is interfaced to the column driver IC 16 mounted to each of the grouped connection members 18.

Timing controllers 22*a* and 22*b* can be mounted together onto a single PCB or independently to separate PCBs 20*a* and 20*b*. The embodiment of the flat panel display shown in FIG. 1 has separate PCBs 20*a* and 20*b* with timing controllers 22*a* and 22*b* mounted thereon, respectively.

Data are transmitted to each of timing controllers 22*a* and 22*b* through a distribution unit 26 which is mounted onto a flexible printed board 24. The distribution unit 26 is configured to allocate the data supplied from a predetermined image supply source and supply the allocated data to corresponding timing controllers 22*a* and 22*b*. To this end, it is preferable that the flexible printed board 24 and PCBs 20*a* and 20*b* are interconnected by a conductive member such as an anisotropic conductive film so that the wires thereof can be electrified. In addition, an interface that uses an optical signal transmitting cable depending on the data transmission system can be achieved.

As described above, the flat panel display according to an embodiment of the present invention is configured in that the flexible printed board 24, PCBs 20*a* and 20*b*, connection members 14 and 16, and the display panel 10 are assembled in such a manner that the components are mounted to the corresponding portion, and the data being applied to the column driver IC 16 is from timing controllers 22*a* and 22*b*. As a result, the wiring for data transmission is shortened as a whole.

The flat panel display has a configuration explained below, a signal transmission between the distribution unit 26 and timing controllers 22*a* and 22*b* adopts TTL (transistor—transistor logic)system.

Figure 2:
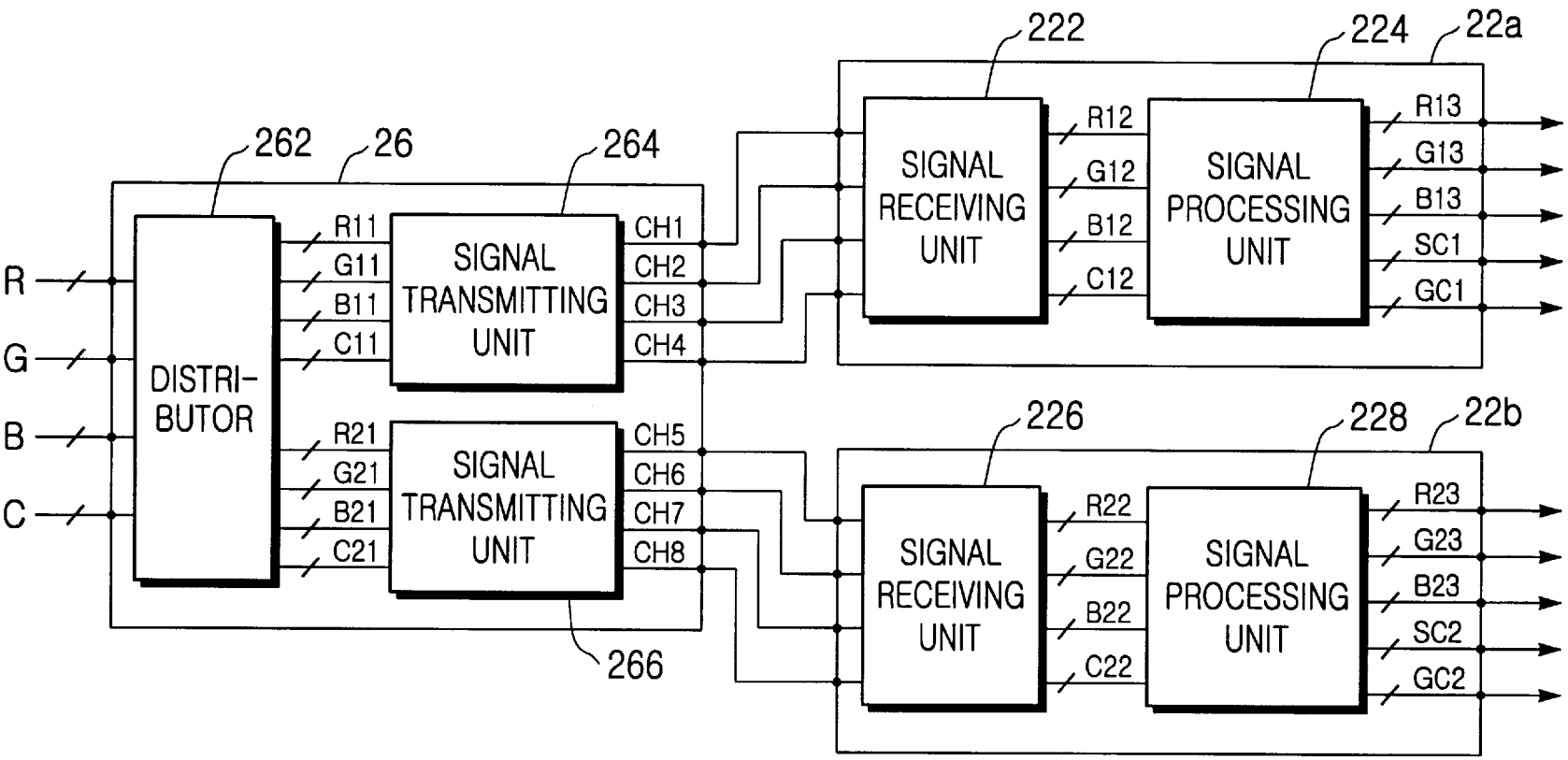
FIG. 2 illustrates a driver circuit applied to the flat panel display shown in FIG. 1.

Referring to FIG. 2, R, G, B data of a plurality of bits, as an image signal, and a control signal C are transmitted from a predetermined image supply source to the distribution unit 26 which in turn allocates data for areas divided into groups and control signals thereof and transmits the allocated data and control signals to timing controllers 22*a* and 22*b*. Subsequently, timing controllers 22*a* and 22*b* determine, using the input control signal, the timing format of the data to be output, generate required control signal, and output data and control signal with respect to each column driver IC 16. The timing controller 22*a* disposed at the side where the scan driver IC 12 is positioned, generates a scan signal and its control signal and outputs the same to the scan driver IC 12.

In the configuration shown in FIG. 1, four column driver ICs constitute a group corresponding to each of timing controllers, and the data and control signals output in the above-described manner are input independently or sequentially to the corresponding column driver ICs. The scan driver IC control signal output from the timing controller 22*a* positioned nearest to the scan driver IC, is applied to the scan driver IC 12 mounted onto the connection member 14 through the wiring connected across the PCB 20*a*, connection member 18 and the display panel 10.

Due to such a configuration, the scan driver IC 12 and the column driver IC 16 output a scan signal and a column signal, respectively, and apply those signal to the display panel 10, to thereby display an image.

In the embodiment, the wiring arranged to apply signals from timing controllers 22*a* and 22*b* to the column driver IC 16 can shorten its length to become half or less of the length of wiring arranged to apply signals from a single timing controller to the entire column driver IC. The shortened wiring can solve the problem of signal delay caused by long wiring.

The data can be transmitted between the distribution unit 26 and timing controllers 22*a* and 22*b* by LVDS(low voltage differential signaling), RSDS(reduced swing differential signaling), or TMDS(time minimized differential signaling) system, as well as the above-mentioned TTL system. For this purpose, the distribution unit 26 is provided with signal transmitting units 264 and 266 for converting TTL signals into those suitable for formats of each system. Further, timing controllers 22*a* and 22*b* are provided with signal receiving units 222 and 226 for converting signals of each system into TTL signals.

Each of signal transmitting units 264 and 266 is constructed to convert TTL signals into those suitable for formats of LVDS, RSDS or TMDS system and output through a predetermined number of channels.

The distribution unit 26 has a distributor 262 to which bits of R, G, B data and the control signal C are input. The distributor 262 outputs signals allocated to signal transmitting units 264 and 266, respectively. Then, data R11, G11, B11 and a control signal C11 are converted into those suitable for format of LVDS, RSDS or TMDS system in the signal transmitting unit 264 and output through channels CHI through CH4, while data R21, G21, B21 and a control signal C21 are converted into those suitable for format of LVDS, RSDS or TMDS system in the signal transmitting unit 266 and output through channels CH5 through CH8.

The signal output through channels CH1 through CH4 is input to the timing controller 22*a*, while the signal output through channels CH5 through CH8 is input to the timing controller 22*b*.

Each of timing controllers 22*a* and 22*b* is provided with signal receiving units 222 and 226 and signal processing units 224 and 228, respectively. Signal receiving units 222 and 226 convert the input signal into the format suitable for TTL system and output the converted signal to signal processing units 224 and 228. Then, the signal processing units 224 and 228 determine the timing format of data with reference to control signals C12 and C22, and output data R13, G13, B13, R23, G23, B23, control signals SC1 and SC2 for column driver ICs, and a control signal GC1 for scan driver ICs. Here. The output signals have formats for TTL system.

Thus, data and control signals are input independently or sequentially to column driver ICs grouped to correspond to each of timing controllers. The scan control signal GC1 output from the timing controller 22*a* which is positioned nearest to scan driver ICs, is applied to each scan driver IC 12 mounted onto the connection member 14 through the wiring connected across the PCB 20*a*, connection member 18 and the display panel 10.

The above-described embodiment of the present invention has the advantageous feature of permitting a high speed data transmission by utilizing signal characteristic of LVDS, RSDS, or TMDS system, while eliminating EMI problems that may occur during the signal transmission between the distribution unit 26 and timing controllers 22*a* and 22*b*.

The wiring arranged to apply signals from timing controllers 22*a* and 22*b* to the column driver IC 16 can shorten its length to become half or less of the length of wiring arranged to apply signals from a single timing controller to the entire column driver IC. The shortened wiring length solves the problem of signal delay caused by the long wiring.

When signal transmitting units 264 and 266 consist of optical signal encoders while signal receiving units 222 and 226 consist of optical signal decoders, and an optical cable is employed for an interconnection between signal transmitting units and signal receiving units, data and control signal can be transmitted by an optical signal transmission between the distribution unit 26 and timing controllers 22*a* and 22*b*. This enables high speed data transmission, while eliminating problems of EMI and signal delay.

While an embodiment where the distribution unit is arranged onto the flexible printed board has been illustrated and described with reference to FIGS. 1 and 2, another embodiment where a distribution unit and a single timing controller are arranged in a single chip will be explained with reference to FIGS. 3 and 4.

Figure 3:
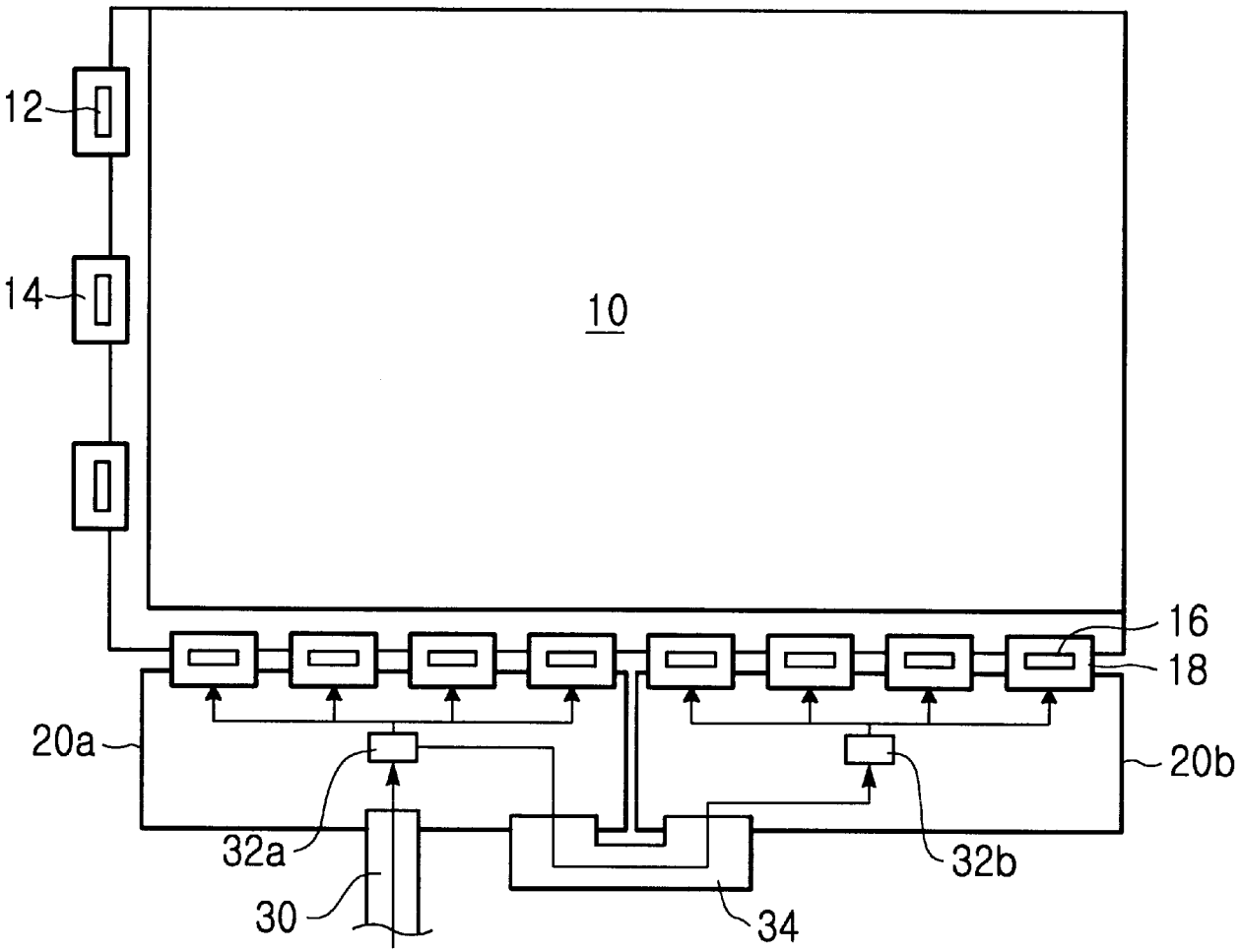
FIG. 3 is a plane view illustrating a flat panel display according to another embodiment of the present invention.

Referring to FIG. 3, connection members 18 mounted with the column driver IC 16 are electrically and physically connected to PCBs 20*a* and 20*b*. A master timing controller 32*a* and a sub-timing controller 32*b* are mounted onto PCBs 20*a* and 20*b* which are arranged separately. An image signal is applied to the master timing controller 32*a* through wires (not shown) electrically connected to a flat wire(30), and the master timing controller 32*a* and the sub-timing controller 32*b* are coupled by a flat wire(34) which electrically connects wires between PCBs 20*a* and 20*b*.

Figure 4:
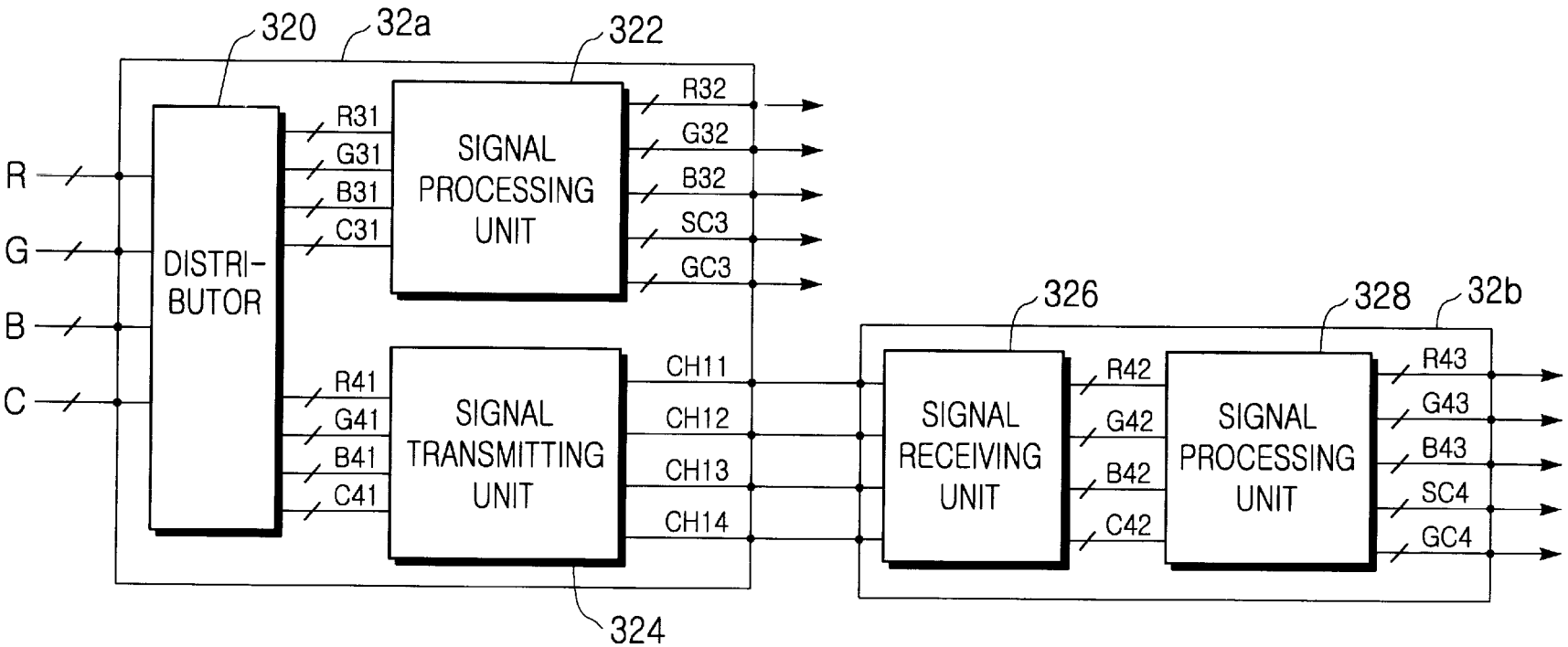
FIG. 4 illustrates a driver circuit applied to the flat panel display shown in FIG. 3.

Referring to FIG. 4, the master timing controller 32*a* includes a distributor 320, a signal processing unit 322 and a signal transmitting unit 324, and the sub-timing controller 32*b* includes a signal receiving unit 326 and a signal processing unit 328.

FIG. 4 illustrates a case where the signal is transmitted between the master timing controller 32*a* and the sub-timing controller 32*b* in LVDS, RSDS or TMDS specification. In such a case, the signal transmitting unit 324 and the signal receiving unit 326 are required for signal conversion between TTL system and other relevant specifications.

When data R, G, B included in an image signal and the control signal C are input to the distributor 320 of the master timing controller 32*a*, the distributor 320 distributes the input signals into groups. Then, the distributor 320 outputs data R31, G31, B31 and a control signal C31 to the signal processing unit 322, and data R41, G41, B41 and a control signal C41 to the signal transmitting unit 324.

The signal processing unit 322 generates a control signal needed for driving the column driver IC 16 or the scan driver IC 12, while at the same time controlling the timing format of the input data R31, G31, B31 with reference to the control signal C31, outputs thus timing-formatted data R32, G32, B32 and a column control signal SC3 to the connection member 18 mounted with the column driver IC 16, and outputs a scan control signal GC3 to the connection member 14 mounted with the scan driver IC 12 through the edges of the connection member 14 and the display panel 10.

In addition, data R41, G41, B41 and the control signal C41 are converted into those with the format suitable for LVDS, RSDS or TMDS system in the signal transmitting unit 324, and output through channels CH11 through CH14. The signal output through channels CH11 through CH14 is input to the sub-timing controller 32*b* which in turn converts the signal input with the format of LVDS, RSDS, or TMDS system into the signal with the format of TTL system and outputs the result to the signal processing unit 328. Subsequently, the signal processing unit 328 determines the timing format of data R42, G42, B42 with reference to a control signal C42, and outputs data R43, G43, B43, R43, SC4 which have formats suitable for TTL system.

As described above, the master timing controller 32*a* and the sub-timing controller 32*b* which are mounted onto the separately arranged PCBs 20*a* and 20*b*, respectively, correspond to the grouped column driver ICs 16 mounted onto connection members 18 which are connected to one another for each of the separate PCBs.

Column driver ICs 16 are provided with data and a control signal, and scan driver ICs 12 are provided with a scan control signal from the master timing controller 32*a*, thus allowing the display panel 10 to form a predetermined image to be displayed.

The embodiment described with reference to FIGS. 3 and 4, has the advantageous feature of permitting a high speed data transmission by utilizing signal characteristic of LVDS, RSDS, or TMDS system, while eliminating EMI problems which may occur during the operation of data transmission.

Like the embodiment described with reference to FIG. 1, the embodiment shown in FIG. 3 has wiring arranged to apply signals from a plurality of timing controllers to the column driver IC 16 and shortened its length to become half or less of the length of wiring arranged to apply signals from a single timing controller to the entire column driver IC. The shortened length of wiring can solve the problem of signal delay caused by the lengthened wiring.

In the embodiment described with reference to FIG. 3, the signal transmitting unit consists of an optical signal encoder, and the signal receiving unit consists of an optical signal decoder, thus allowing an optical signal transmission system which utilizes an optical cable, to be employed for an interconnection between the signal transmitting unit and the signal receiving unit. Thus, high-speed data transmission can be achieved, while eliminating problems of EMI and signal delay.

The present invention has an advantage in that a plurality of timing controllers and a distribution unit are arranged so as to shorten the data transmission path, thereby eliminating problems of signal delay.

Furthermore, the flat panel display according to the present invention selectively adopts LVDS, RSDS, TMDS or an optical communication system, as a signal transmission system, thereby eliminating EMI problems.

Due to above-described advantageous features of the present invention, flat panel displays can have screens large size.

What is claimed is:

1. A flat panel display, comprising:

a display panel for displaying a predetermined image into a screen based on a scan signal and a column signal;

a plurality of first connection members electrically and physically connected to a first side of said display panel;

a plurality of second connection members electrically and physically connected to a second side of said display panel;

a plurality of scan driver units for supplying the scanning signal to said display panel, each scan driver unit mounted on a corresponding one of said plurality of first connection members;

a plurality of column driver units for supplying the column signal to said display panel and divided into a plurality of column driver unit groups, each column driver unit mounted on a corresponding one of said plurality of second connection members;

a printed circuit board (PCB) electrically and physically connected to the second connection members;

a plurality of timing controllers mounted on said PCB, each provided to a corresponding one of said plurality of column driver unit groups for supplying a data signal and a control signal thereto; and a distributing unit for distributing the data signal and the control signal supplied from a image supply source to said plurality of timing controllers.

2. The flat panel display according to claim 1, comprising a plurality of PCBs provided corresponding to the plurality of column driver unit groups, each PCB physically and electrically connected to the second connecting members of the corresponding column driver unit group, wherein each timing controllers is mounted on a corresponding one of said plurality PCBs and electrically connected to the second connecting members of the corresponding column driver unit group.

3. The flat panel display according to claim 1, wherein data transmission between said distribution unit and said timing controllers is performed in TTL system.

4. The flat panel display according to claim 1, wherein said distributing unit further comprises a distributor for distributing data and a signal transmitting section for converting TTL signal output from said distributor into a signal having a format suitable for a predetermined system, and each of said timing controllers further comprises a signal receiving unit for converting an input signal into a signal with a format suitable for TTL system.

5. The flat panel display according to claim 4, wherein said signal transmitting unit and said signal receiving unit perform data conversion between TTL system and RSDS system.

6. The flat panel display according to claim 4, wherein said signal transmitting unit and said signal receiving unit perform data conversion between TTL system and LVDS system.

7. The flat panel display according to claim 4, wherein said signal transmitting unit and said signal receiving unit perform data conversion between TTL system and TMDS system.

8. The flat panel display according to claim 4, wherein said signal transmitting unit and said signal receiving unit perform data conversion between TTL system and optical transmission system.

9. A flat panel display, comprising:

a display panel for displaying a predetermined image onto a screen based on a scan signal and a column signal;

a plurality of first connection members electrically and physically connected to a first side of said display panel;

a plurality of second connection members electrically and physically connected to a second side of said display panel;

a plurality of scan driver units for supplying the scanning signal to said display panel, each scan driver unit mounted on a corresponding one of said plurality of first connection members;

a plurality of column driver means units for supplying the column signal to said display panel and divided into a plurality of column driver unit groups, each column driver unit mounted on a corresponding one of said plurality of second connection members;

a plurality of printed circuit boards (PCBs), each electrically and physically connected to the second connection members of a corresponding one of the plurality of column driver unit groups, the plurality of column driver unit groups including a first group and a second group;

a master timing controller mounted onto the PCB for the first group and comprising:

a distributor for distributing signals supplied from an image supply source to the plurality of column driver unit groups;

a signal processing unit for determining a timing format of the signal for the first group and generating and outputting a control signal corresponding to the determined timing format; and a signal transmitting unit for outputting the signal for the second group; and a sub-timing controllers mounted on the PCB for the second group receiving the signal for the second group transmitted from said master timing controller, determining a timing format of the received signal, and generating and outputting a control signal corresponding to the determined timing format.

10. The flat panel display according to claim 9, wherein data transmission between said master timing controller and said sub-timing controller is performed in TTL system.

11. The flat panel display according to claim 9, wherein said master timing controller further comprises a signal transmitting section for converting TTL signal output from said distributor into a signal having a format suitable for a predetermined system, and said sub-timing controller further comprises a signal receiving unit for converting an input signal into a signal with a format suitable for TTL system.

12. The flat panel display according to claim 11, wherein said signal transmitting unit and said signal receiving unit convert data between TTL system and RSDS system.

13. The flat panel display according to claim 11, wherein said signal transmitting unit and said signal receiving unit convert data between TTL system and LVDS system.

14. The flat panel display according to claim 11, wherein said signal transmitting unit and said signal receiving unit convert data between TTL system and TMDS system.

15. The flat panel display according to claim 11, wherein said signal transmitting unit and said signal receiving unit convert data between TTL system and optical transmission system.

* * * * *

UNITED STATES PATENT AND TRADEMARK OFFICE

CERTIFICATE OF CORRECTION

PATENT NO. : 6,657,622 B2
DATED : December 2, 2003
INVENTOR(S) : Jin-Ho Park

It is certified that error appears in the above-identified patent and that said Letters Patent is hereby corrected as shown below:

Column 8,
Line 9, between the words “driver” and “units”, delete the term “means”.

Signed and Sealed this

Sixteenth Day of March, 2004

JON W. DUDAS
*Acting Director of the United States Patent and Trademark Office*